United States Patent [19]

Julian

[11] Patent Number: 4,884,706

[45] Date of Patent: Dec. 5, 1989

[54] TAMPER INDICATING CONTAINER AND CLOSURE

[75] Inventor: Randall K. Julian, Evansville, Ind.

[73] Assignee: Sunbeam Plastics Corporation, Evansville, Ind.

[21] Appl. No.: 313,084

[22] Filed: Feb. 21, 1989

[51] Int. Cl.[4] ..... B65D 41/34

[52] U.S. Cl. ..... 215/252; 215/31

[58] Field of Search ..... 215/31, 252, 258

[56] References Cited

U.S. PATENT DOCUMENTS 4,546,892 10/1985 Couput ..... 215/252

4,595,110 6/1986 Herr ..... 215/252

*Primary Examiner*—Donald F. Norton

*Attorney, Agent, or Firm*—Gifford, Groh, Sheridan, Sprinkle and Dolgorukov

[57] ABSTRACT

A tamper indicating package including a container having integrally molded flexible retainer means for engaging and resisting the movement of a tamper indicating ring attached to a closure by frangible means so that separation of the ring of the closure indicates tampering.

19 Claims, 1 Drawing Sheet

TAMPER INDICATING CONTAINER AND CLOSURE

BACKGROUND OF THE INVENTION

This invention relates to tamper indicating closures and containers by which a tamper indicating ring formed as part of the closure is separated from the closure when an attempt is made to remove the closure thereby indicating tampering.

Tamper indicating closures and containers of a popular type typically employ a closure having an annular skirt with a tamper indicating ring connected thereto by frangible means so that any effort to remove the closure from the container causes the tamper indicating ring to be held against axial movement by engagement of retainer or stop means on the container and on the closure so that the tamper indicating ring separates from the closure giving evidence of an effort to remove the closure and therefore of tampering.

In one form of such tamper indicating closures and containers the stop means on the tamper indicating ring and on the container are in the form of complementary annular beads which engage each other after the closure is first applied to the container to resist removal of the ring from the container. Difficulties are encountered in applying the closure to the container because the interference of the beads on the container and closure sometimes results in premature fracture of the frangible means by which a tamper indicating ring is attached to the closure. In an effort to avoid this problem, attempts have been made to substitute flexible stop means or fingers or annular flanges for the fixed bead on the tamper indicating ring. An example of such structure can be found in U.S. Pat. No. 4,470,513 to Ostrowsky. In that patent the stop means on the tamper indicating ring are in the form of flexible fingers which engage the beads on the exterior of the container neck after the closure has been applied to the container. Any attempt to remove the closure from the container causes engagement of the free ends of the fingers with the underside of the container bead thereby causing a separation of the tamper indicating ring from the closure to indicate tampering.

Both forms of tamper indicating packages have deficiencies which the present invention overcomes.

SUMMARY OF THE PRESENT INVENTION

The present form of the invention has advantages over the tamper indicating arrangements of the prior art in which beads on a tamper indicating ring cooperate with a bead on a container to resist removal of the tamper indicating ring. In those structures a high torque is required to snap the tamper indicating bead over the container bead and sometimes there is premature fracture of the ring and separation from the closure. In the present form of the invention there is a lower torque or load required to apply the cap to the closure. Also, the correct operation of the tamper indicating mechanism is constant over a relatively wide range of cap dimensions which is not tolerated in package forms employing co-acting beads.

The present form of the invention also has advantages over the form of the closure in the Ostrowsky structure. Such structures require formation of a closure and subsequent operations are required to fold the flexible fingers inwardly and upwardly relative to the closure. In the present form of the invention a large variety of tamper indicating closures can be used and the flexible fingers or retainer can be molded on the container in any position convenient to the molding operation because the fingers are automatically moved to their desired position upon application of the closure to the container so that the second operation of separately folding the fingers is eliminated.

BRIEF DESCRIPTION OF THE DRAWING

These and other advantages of the invention contribute to satisfaction in use and economy in manufacture and will be more fully understood when considered in connection with the following description of preferred embodiments of the invention shown in the accompanying drawings in which.

DETAILED DESCRIPTION OF THE PREFERRED EMBODIMENT

Figure 1:
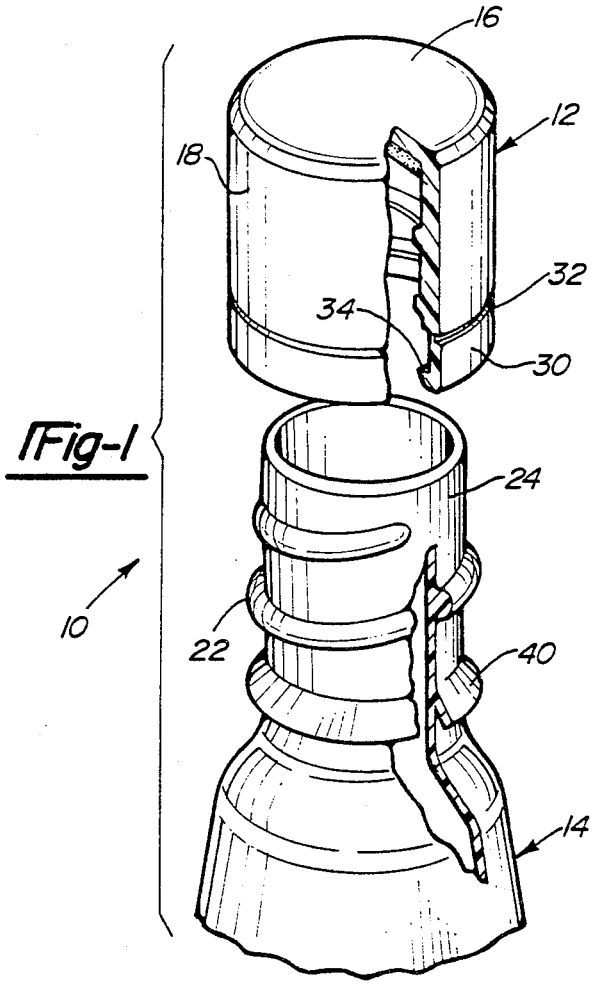
FIG. 1 is a perspective view showing a tamper indicating container and closure embodying the invention with the closure separate from the container.

Referring to the drawings a package embodying the invention is designated generally by the numeral 10 and includes a tamper indicating closure designated 12 and a container generally designated by the numeral 14.

Both the closure 12 and container 14 can be made of any conventional thermoplastic material such as polyvinyl chloride, polyethylene, polyethylene terephtyalate or similar materials. The closure 12 can be produced by injection molding and the thermoplastic container of this invention can be produced by either injection molding or injection blow molding techniques.

The closure 12 has a disk-shaped top wall 16 and an annular depending skirt or sidewall 18. The skirt 18 is provided with fastening means in the form of a thread 20 complementary to and engageable with a thread 22 formed on the neck portion 24 of the container 14.

Although threads 20 and 22 are preferred as the fastening means other means for detachably securing a cap to a container may be used.

The closure 12 is provided with a tamper indicating ring 30 which is disposed below the lower edge of the skirt 18. Typically, the skirt 18 and tamper indicating ring are connected to each other by means of frangible webs 32. The webs 32 form a line of weakening which permits easy fracture and separation of the tamper indicating ring 30 from the remainder of the closure 12.

The lower edge of the tamper indicating ring 30 is provided with an inwardly extending annular lip or flange 34 forming part of the stop or retainer means.

The container 14 of the present invention is formed of thermoplastic material and is provided with retainer means 40 disposed below the container threads 22 and completely encircling the neck portion 24. The retainer means 40 is relatively thin and is flexible relative to the thicker and more rigid neck portion 24. The retainer means 40 extends radially outwardly and downwardly in its as molded condition. The outer edge 42 of the retainer means projects outwardly and radially a distance greater than the internal diameter of the lip or flange 34.

The internal diameter of the lip 34 is no less than and preferably slightly greater than the outer diameter of the threads 22 on the neck portion 24. As a result upon application of the closure 12 to the container 14 the lip 34 passes freely over the threads 22 and after the neck threads 22 and skirt threads 20 engage, turning of the closure 12 to further engage the threads causes the closure 12 to move axially downwardly until a cam surface 44 seen in FIGS. 2 and 3 formed on the bottom of the lip 34 engages the top surfaces of the retainer means 40 causing it to be flexed downwardly relative to the neck portion 24. As the closure 12 approaches a closed position on container 14 the lip 34 passes downwardly beyond the outer edge 42 of the retainer means 40 permitting the retainer means 40 to resiliently return towards its as molded condition and to occupy a position such as that illustrated in FIG. 3. In that position the retainer means 40 is engaged with the top surface 46 of the lip or flange 34. This is the fully closed position of the package 10.

Figure 3:
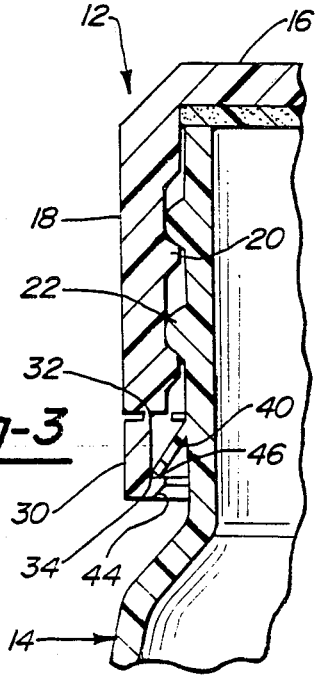
FIG. 3 is a cross-sectional view of the closure and container showing the closure in a closed position on the container.

From the fully closed position illustrated in FIG. 3, any effort to remove the closure 12, for example, by unthreading the closure 12, causes the cap to move axially upwardly. However, the tamper indicating ring 30 is held axially fixed by the interference of retainer means 40 with flange 34. As a result the frangible web 20 fracture causing separation of the tamper indicating ring 30 from the remainder of the closure. Further unthreading of the closure 12 permits its complete removal from the neck portion 24 leaving the tamper indicating ring 30 held captive on the neck portion 24 by the retainer means 40. After the closure is returned to its closed position on the container 14 the separation of the tamper indicating ring 30 from the remainder of the closure 14 is evident, thereby indicating a prior opening or an attempt to open the package 10.

Figure 2:
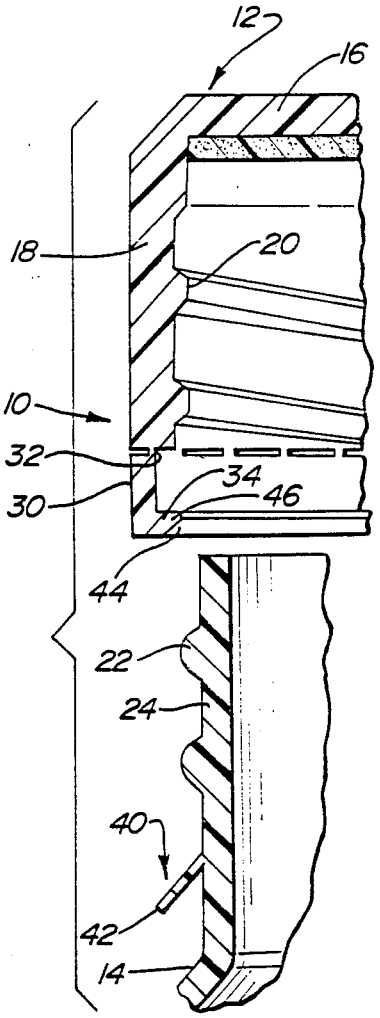
FIG. 2 is a cross-sectional view of the closure and container shown in FIG. 1.
Figure 4:
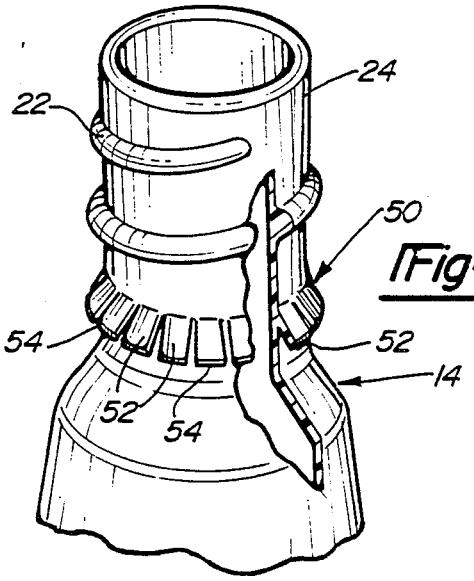
FIG. 4 is a view of a container showing another embodiment of the invention.

Another embodiment of the invention is disclosed in FIG. 4 in which retainer means 50 in the form of a plurality of fingers 52 are substituted for the retainer means 40 disclosed in FIGS. 1 through 3. The fingers 52 serve essentially the same function as the retainer means 40. The fingers have free ends 54 which engage the lip 34 on the tamper indicating ring 30 when the closure 12 is in a closed position on the container 14. An attempt to remove the closure 12 causes the fingers to resist axial upward movement of the tamper indicating ring 30 causing fracture of the webs 32 to place the tamper indicating ring 30 in its tamper indicating condition.

The configuration of the retaining means 40 and the fingers 52 of the retainer means 50 can vary in cross-section so long as they are sufficiently flexible relative to the container neck 14 and are sufficiently resilient to tend to return to an as molded condition so that when they are deflected downwardly and inwardly they tend to return to their as molded condition to locate the free ends or edge 42 or the free ends 54 on the upper surface 46 of the tamper indicating ring 30. The fingers also must be sufficiently stiff to resist upward movement of the ring 30.

Although the retainer means 40 and 50 are disclosed as extending radially outwardly and downwardly they can be molded to extend radially outwardly at any chosen angle to the container neck portion 24 so long as the outer edge 42 or the free ends 54 extend sufficiently to be engaged by the tamper indicating ring 30 during movement of closure 12 to its closed position.

Having thus described my invention, however, many modifications thereto will become apparent to those skilled in the art to which it pertains without deviation from the spirit of the invention as defined by the scope of the appended claims.

I claim:

1. A container for use with a tamper indicating closure of the type having an annular skirt and a tamper indicating ring attached to said skirt and separable therefrom upon axial movement of said closure from a closed to an open position relative to said container, said container comprising:

a neck portion having fastening means for cooperation with complementary fastening means on said closure, retainer means flexible relative to said container and extending radially outwardly and downwardly from said neck portion below said fastening means, said retainer means having end portions engageable with complementary lip means on said tamper indicating ring to resist axial movement of said tamper indicating ring relative to said container upon separation of said complementary fastening means during removal of said closure from said container.

2. The combination of claim 1 wherein said retainer means are formed integrally with said container.

3. The combination of claim 1 wherein said flexible retainer means is continuous around the periphery of said neck portion.

4. The combination of claim 1 wherein said flexible retainer means is formed by a plurality of flexible fingers.

5. The combination of claim 4 wherein said fingers are uniformly spaced around the periphery of said neck portion.

6. The combination of claim 1 wherein said flexible retainer means are engageable by said tamper indicating ring to deflect said flexible retainer means downwardly upon application of the tamper indicating ring to the container for the first time.

7. The combination of claim 1 wherein said fastening means are complementary threads formed on said closure and said neck portion.

8. The combination of claim 1 wherein said flexible retainer means extend radially outwardly a distance greater than the internal diameter of said tamper indicating ring.

9. The combination of claim 1 wherein said tamper indicating ring has an internal diameter greater than the external diameter of said fastening means on said neck portion.

10. A tamper indicating package comprising:

a closure having a top wall portion and an integral annular skirt extending therefrom, fastening means formed on the interior of said annular skirt, a tamper indicating ring disposed below said annular skirt and attached to the latter by means including frangible portions, said tamper indicating ring having a radially inwardly extending lip, a container having a neck portion, fastening means formed on said neck portion and being complementary to said fastening means on said annular skirt, and retainer means extending radially outwardly and downwardly from said container and being flexible relative thereto to engage said lip portion on said tamper indicating ring when said closure is in its closed position to resist axial upward movement of said tamper indicating ring relative to said container upon removal of said closure from said container.

11. The tamper indicating package of claim 10 wherein said retainer means are formed integrally with said container neck portion.

12. The combination of claim 10 wherein said flexible retainer means is continuous around the periphery of said neck portion and formed integrally therewith.

13. The combination of claim 10 wherein said flexible retainer means is formed by a plurality of flexible fingers having one end integrally formed with said neck portion.

14. The combination of claim 13 wherein said fingers are uniformly spaced around the periphery of said neck portion.

15. The combination of claim 10 wherein said flexible retainer means are engageable by said closure upon applying the closure to said container to deflect said flexible stop means downwardly.

16. The combination of claim 10 wherein said fastening means on said closure and on said container are complementary threaded portions.

17. The combination of claim 10 wherein said flexible retainer means extend radially outwardly a distance greater than the diameter of said tamper indicating ring.

18. The combination of claim 10 wherein said retainer means extend radially outwardly and downwardly with the outer edge of said stop means engaging said radially inwardly extending lip.

19. The combination of claim 10 wherein said tamper indicating ring has an internal diameter greater than the external diameter of said fastening means on said container.

* * * * *